US006695048B2

(12) United States Patent
Andersen et al.

(10) Patent No.: US 6,695,048 B2
(45) Date of Patent: Feb. 24, 2004

(54) SEGMENTED TUBING GUIDE

(75) Inventors: Joshua Nathan Andersen, Duncan, OK (US); Larry Lance Austbo, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/801,365

(22) Filed: Mar. 7, 2001

(65) Prior Publication Data

US 2003/0159821 A1 Aug. 28, 2003

(51) Int. Cl.[7] ..... E21B 19/22

(52) U.S. Cl. ..... 166/77.2; 166/77.1; 166/85.5; 226/189; 226/194; 226/90; 242/615.3

(58) Field of Search ..... 166/77.2, 77.3, 166/77.4, 85.5, 77.1; 242/615.3; 226/189, 194, 90

(56) References Cited

U.S. PATENT DOCUMENTS

| | | | |
|---|---|---|---|
| 4,448,568 | A | 5/1984 | Gentry et al. |
| 4,515,220 | A | 5/1985 | Sizer et al. |
| 4,625,796 | A | 12/1986 | Boyadjieff |
| 4,655,291 | A | 4/1987 | Cox |
| 5,088,559 | A | 2/1992 | Taliaferro |
| 5,094,340 | A | 3/1992 | Avakov |
| 5,234,053 | A | 8/1993 | Connell |
| 5,244,046 | A | 9/1993 | Council et al. |
| 5,279,364 | A | 1/1994 | Jantzen et al. |
| 5,799,731 | A | 9/1998 | Avakov et al. |

*Primary Examiner*—David Bagnell
*Assistant Examiner*—Giovanna Collins
(74) *Attorney, Agent, or Firm*—John W. Wustenberg; Anthony L. Rahhal

(57) ABSTRACT

A tubing guide for directing coiled tubing through an injector apparatus and into a well. The tubing guide comprises a frame, which is also referred to as a tubing carrier, extending from a base. The shape of the tubing guide changes depending upon the natural radius of curvature of the tubing. The tubing carrier will conform to provide a path for the coiled tubing that more nearly approximates the residual radius of curvature of the coiled tubing. The carrier has a plurality of segments pivotably connected to one another. The segments can pivot and thus the carrier itself can move from a fully retracted position to a fully rotated position. In the fully rotated position, the carrier can approximate a radius larger than that in the fully closed position. The segments are allowed to pivot or rotate as the tubing is passing therethrough so that the shape of the carrier is continually adjusting so as to provide a more natural path for the coiled tubing.

30 Claims, 8 Drawing Sheets

SEGMENTED TUBING GUIDE

BACKGROUND OF THE INVENTION

This invention relates to a gooseneck, which is also referred to as a tubing guide, and more particularly to a tubing guide for directing coiled tubing into a coiled tubing injector apparatus. Reeled or coiled tubing has been run into completed wells for many years for performing certain downhole operations. Those operations include, but are not limited to, washing out sand bridges, circulating treating fluids, setting downhole tools, cleaning and internal walls of well pots, conducting producing fluids or lift gas, and a number of other similar remedial or production operations. The tubing utilized for such operations is generally inserted into the wellhead through a lubricator assembly or stuffing box. Typically, there is a pressure differential on the well so that the well is a closed chamber producing oil or gas or a mixture thereof from the pressurized well. The tubing that is inserted into the well is normally inserted through a lubricator mechanism which seals the well for pressure retention in the well.

The tubing is flexible and can bend around a radius of curvature and is normally supplied on a drum or reel. The tubing is spooled off the reel and inserted into a coiled tubing injector assembly. The coiled tubing injector assembly essentially comprises a curvilinear gooseneck, or tubing guide and a coiled tubing injector apparatus positioned therebelow.

The curvilinear tubing guide forms an upper portion of the injector assembly while the coiled tubing injector apparatus forms a lower portion thereof. Most coiled tubing injector apparatus utilize a pair of opposed inlet drive chains arranged in a common plane. Such drive chains are made up of links, rollers and gripper blocks. The drive chains are generally driven by sprockets powered by a motor which is a reversible hydraulic motor. The opposed drive chains grip the coiled tubing between them. The drive chains are backed up by linear beams, also referred to as pressure beams, so that a number of pairs of opposed gripping blocks are in gripping engagement with the tubing at any given moment. Coiled tubing injector apparatus are shown in U.S. Pat. No. 5,094,340 to Avakov, which is incorporated herein by reference for all purposes, and U.S. Pat. No. 4,655,291 to Cox, which is likewise incorporated herein for all purposes.

A typical tubing guide has a curvilinear first frame portion with a set of rollers or tubing guide strips thereon which support and guide the tubing as it is moved through the injector. Spaced from the first frame portion is a second frame portion which may also have a set of rollers thereon, which are on the opposite side of the tubing from the first set of rollers and which also act to guide the tubing. The tubing guide is pivotable for easy alignment with the tubing reel. The radius of curvature of the typical tubing guide is constant and is typically smaller than the residual or natural radius of curvature of the coiled tubing in its free state after it has been spooled off the reel. The rollers therefore force the tubing to bend to match the curvature of the tubing guide and to straighten the tubing so that it is substantially vertical when it exists the tubing guide and enters the coiled tubing injector apparatus therebelow. The bending stresses experienced by the tubing each time it is deformed or bent and injected into the well decrease the life of the coiled tubing.

During a typical coiled tubing job, the pipe may be subjected to at least six bending stages. Going into the well, the first bending stage occurs when the plastically shaped tubing leaves the tubing reel and is straightened on its way to the tubing guide. The second is the bending of the now straightened coiled tubing around the tubing guide. The third is the straightening of the coiled tubing that has been bent around the tubing guide through the tubing injector so that it can be directed into the well. Out of well deformation occurs as the straightened tubing is withdrawn from the well through the tubing injector and deformed around the tubing guide. Additional deformation occurs when the bent tubing leaves the tubing guide and is straightened somewhat on its way to the reel. The third and final deformation is when the straightened tubing is wrapped onto the reel. Thus, coiled tubing may see six bending stages or deformations per trip in and out of the well. The low cycle fatigue generated by the deformation is a limiting factor in the life expectancy of a coiled tubing string.

Tubing guides have evolved in shape and size. The first tubing guides were created to provide a framework around which to bend pipe to lead it into the injector. It became apparent that the radius of the tubing guide had a definite impact on the life expectancy of the tubing, so that larger radius tubing guides were designed to increase the fatigue life of the tubing. The first large radius tubing guides were, however, like their predecessors a continuous single radius. Many present day tubing guides utilize a continuous single radius. Because the size of the tubing guide is limited by a number of factors, and because of various requirements during rig-up, namely, the position of the coiled tubing relative to the tubing guide, large radius tubing guides, while having better fatigue benefits than small radius tubing guides, still create fatigue problems that impact the life of the coiled tubing and in some instances provide difficulties in the installation of the tubing.

Typically, to install the coiled tubing, the end thereof is stabbed into the tubing guide at or near the base of the tubing guide assembly to help direct the tubing into the injector. Very often curvature of the tubing will be such that once it is stabbed, there is a fairly large distance between the coiled tubing and the tip or end of the tubing guide. Thus, it is necessary to apply pressure to the coiled tubing to pull it down to the tubing guide. One manner of doing so is using a hand winch, which is commonly referred to as a come-along, to pull the tubing down to the tubing guide. Once the tubing has reached the tubing guide, rollers or other means are utilized to hold the tubing to the tubing guide so that it can then be directed around the tubing guide into the injector. Such procedures are time consuming, can sometimes be dangerous and can also increase the bending stresses in the tubing.

One prior art resolution to the problems associated with the continuous radius tubing guide is the variable radius tubing guide such as that shown in U.S. Pat. No. 5,799,731 to Avakov et al., assigned to the assignee of the present invention, the details of which are incorporated herein by reference. The variable radius tubing guide shown therein combines a larger radius near the base of the tubing guide with a small radius near the tip of the tubing guide. The smaller profile at the tip allows more versatility during rig-ups while the larger bend radius accommodates the natural radius of larger coiled tubing as it moves off the reel. While the tubing guide shown in the '731 patent addresses the problem of fatigue on coiled tubing, there is still a need in the industry for a tubing guide that will lessen further the bending experienced by the tubing, thus lessening the fatigue effects. Thus, there is a need for an improved tubing guide and a method of directing tubing into the injector which will lessen bending and thus lessen the fatigue effect on the tubing and which will provide for easier installation of the tubing around the tubing guide.

SUMMARY OF THE INVENTION

The present invention provides an improved tubing guide for directing coiled tubing into a well. The tubing guide comprises a base and a frame extending therefrom. The tubing guide is a conformable tubing guide and thus has a conformable or adjustable shape. The shape of the tubing will conform depending on the natural radius of curvature of the tubing being placed thereon, so that the tubing can follow a path that more nearly approximates the residual or natural radius of curvature of the tubing. The tubing carrier preferably is a segmented tubing carrier comprising a plurality of frame segments. Each of the frame segments is connected near a rear end thereof to a location near the forward end of the adjacent segment. The segments are pivotably connected to one another so that the tubing carrier can conform or adjust to any number of shapes thereby allowing the carrier to conform to more nearly approximate the natural radius of curvature of the tubing placed thereon.

The tubing carrier preferably has first, second, third and fourth segments. The fourth segment is connected to the base of the tubing guide. The first segment is pivotably connected to the second segment near the rear end of the first segment. Likewise, the second segment is pivotably connected near its rear end to the third segment and the third segment is pivotably connected at its rear end to the fourth segment. Pivotal movement, or rotation of the segments, is limited to a maximum or minimum rotation so that the carrier will have a fully closed and a fully open or rotated position. By conforming or adjusting, the tubing guide will alleviate some of the bending stresses normally associated with placing a tubing on a tubing guide and directing the tubing into a coiled tubing injector by allowing the path of the coiled tubing to more nearly approximate its natural, or residual shape or radius. The present invention also provides for an easier installation or rig-up since the tubing carrier segments can be rotated so that the tubing carrier can conform to the shape of the tubing, or to at least partially conform to the shape of the tubing, to eliminate, or at least to lessen the amount of mechanical force that must be applied to the coiled tubing to bring the tubing into engagement with the tubing guide.

It is therefore a general object of the present invention to provide an improved tubing guide which provides easier rig-up and installation and which lessens the bending stresses normally associated with the operation of the tubing guide. Other and further objects, features and advantages of the present invention will be readily apparent to those skilled in the art in view of the drawings herein and a reading of the description of the preferred embodiment which follows.

DESCRIPTION OF THE PREFERRED EMBODIMENTS

Figure 1:
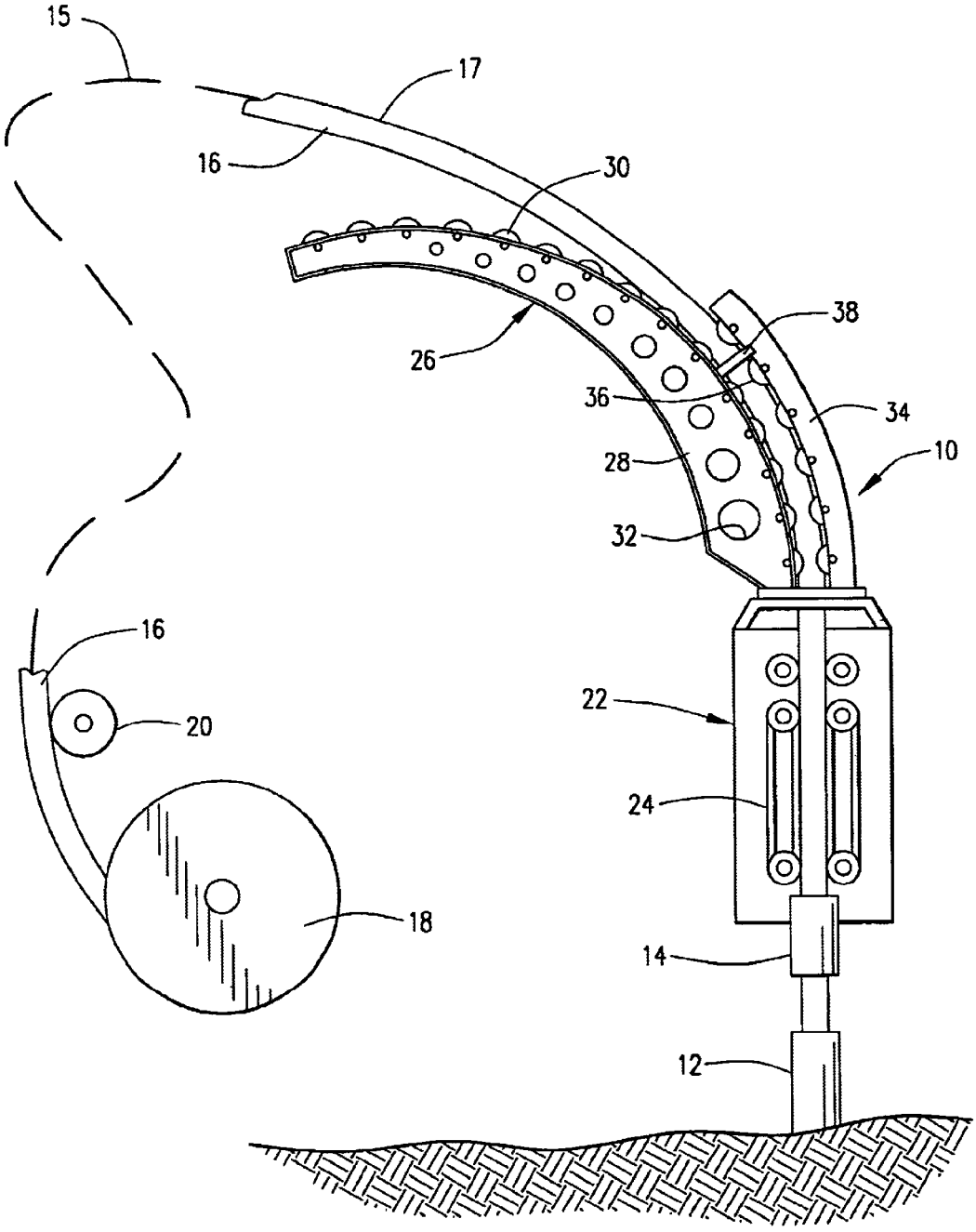
FIG. 1 PRIOR ART
FIG. 1 is a prior art tubing guide.

Referring now to the drawings, and more particularly to FIG. 1, a prior art coiled tubing injector assembly is shown and generally designated by the numeral 10. The assembly 10 is positioned over a wellhead 12 which is provided with a stuffing box or lubricator 14. Tubing 16 is provided to assembly 10 on a large drum or reel 18, and typically is several thousand feet in length. Tubing 16 has a longitudinal central axis 15 and an outer diameter, or surface 17. The tubing is in a relaxed, but coiled, state when supplied from drum or reel 18. The tubing has a natural, or residual radius of curvature when it is in its relaxed state after being spooled from the reel.

The well is typically pressure isolated. That is, entry of tubing 16 into the well must be through stuffing box 14 which enables the tubing, which is at atmospheric pressure, to be placed in the well which may operate at higher pressures. Entry into the well requires that the tubing be substantially straight. To this end, the assembly 10 incorporates a coiled tubing injector apparatus 22 which is constructed with drive chains which carry blocks adapted for gripping tubing 16. The details of drive chains and blocks 24 are known in the art. See for example, U.S. Pat. No. 5,094,340 entitled "GRIPPER BLOCKS FOR REELED TUBING INJECTORS," the details of which have been incorporated herein by reference.

A tubing guide 26 is attached to the upper end of coiled tubing injector apparatus 22. Typically, tubing guide 26 is pivotable about a vertical axis with respect to the injector 22 positioned therebelow. Tubing guide 26 includes a curvilinear first or bottom frame 28 having a plurality of first or bottom rollers 30 rotatably disposed thereon. Bottom frame 28 includes a plurality of lightening holes 32 therein.

Spaced from bottom frame 28 is a second or top frame 34 which has a plurality of second or top rollers 36 rotatably disposed thereon. Top rollers 36 generally face at least some of bottom rollers 30. In the embodiment illustrated, the length of curvilinear top frame 34 is less than that of curvilinear bottom frame 28. The distal end of top frame 34 is attached to bottom frame 28 by a bracket 38. Other known tubing guides are shown in U.S. Pat. No. 5,803,168 to Lormand et al., assigned to the assignee of the present invention, the details of which are incorporated herein by reference. That patent discloses the use of tubing guide strips as opposed to rollers. U.S. Pat. No. 5,799,731 to Avakov et al., which is incorporated herein by reference, discloses a variable radius tubing guide.

Prior art tubing guides, while serving their intended purpose, still have inherent difficulties. The tubing guide shown in FIG. 1 will bend and straighten the tubing so that it is vertical as it exits the tubing guide. The bending and the combination of stresses due to the pressures and loads experienced by the tubing due to straightening which occurs each time the tubing is injected, used, and/or withdrawn from the well shortens the life of the tubing.

The tubing guide shown in U.S. Pat. No. 5,799,731 to Avakov et al. resolves some of those difficulties. However, there is still a need for a tubing guide which will further lessen the bending stresses. There is also a need to alleviate some difficulties associated with installation, or "rig-up," namely initially getting the tubing conformed to the shape of the tubing guide. The tubing guide of the present invention addresses those difficulties.

Figure 2:
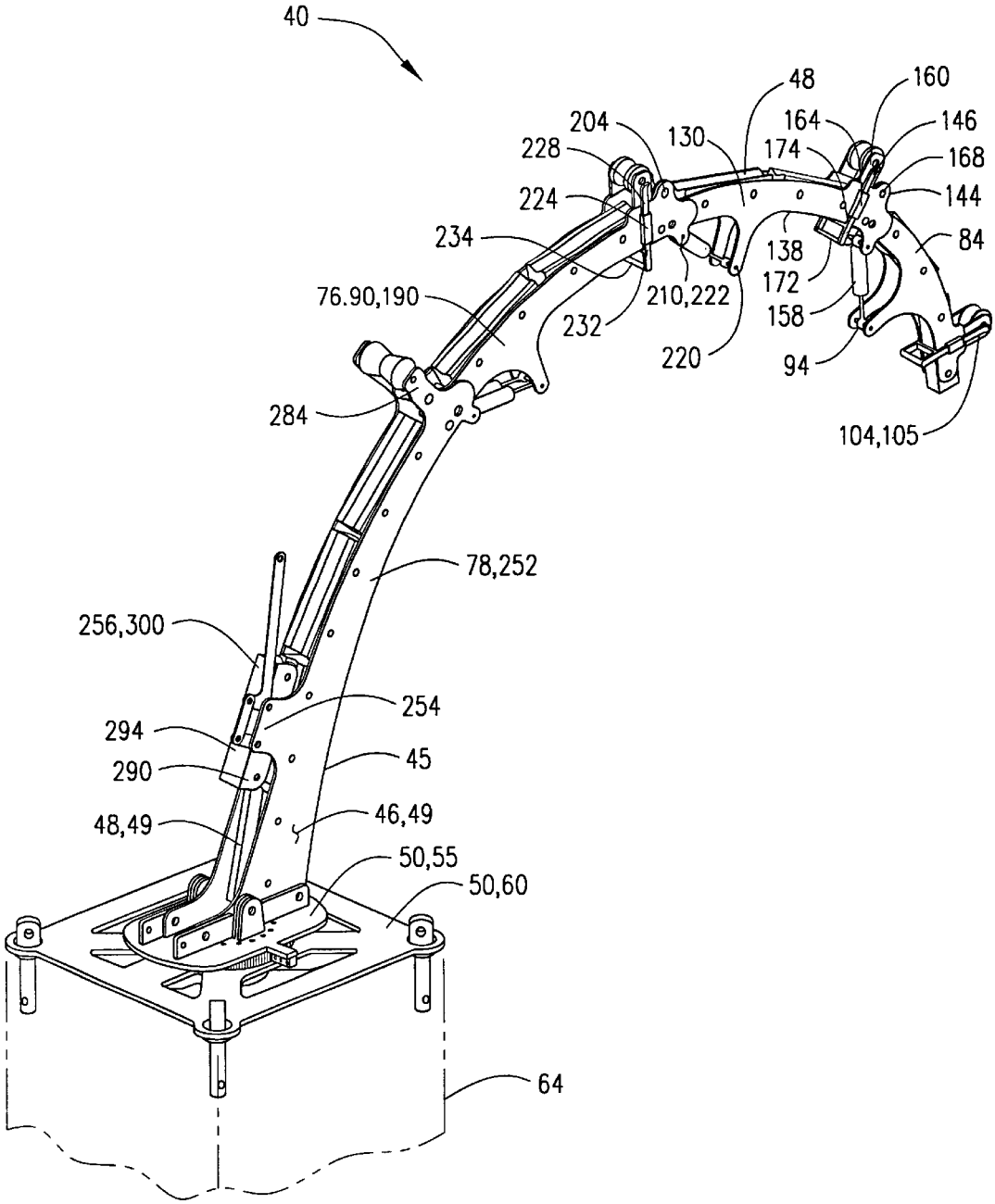
FIG. 2 is a left side perspective view of the tubing guide of the present invention.
Figure 3:
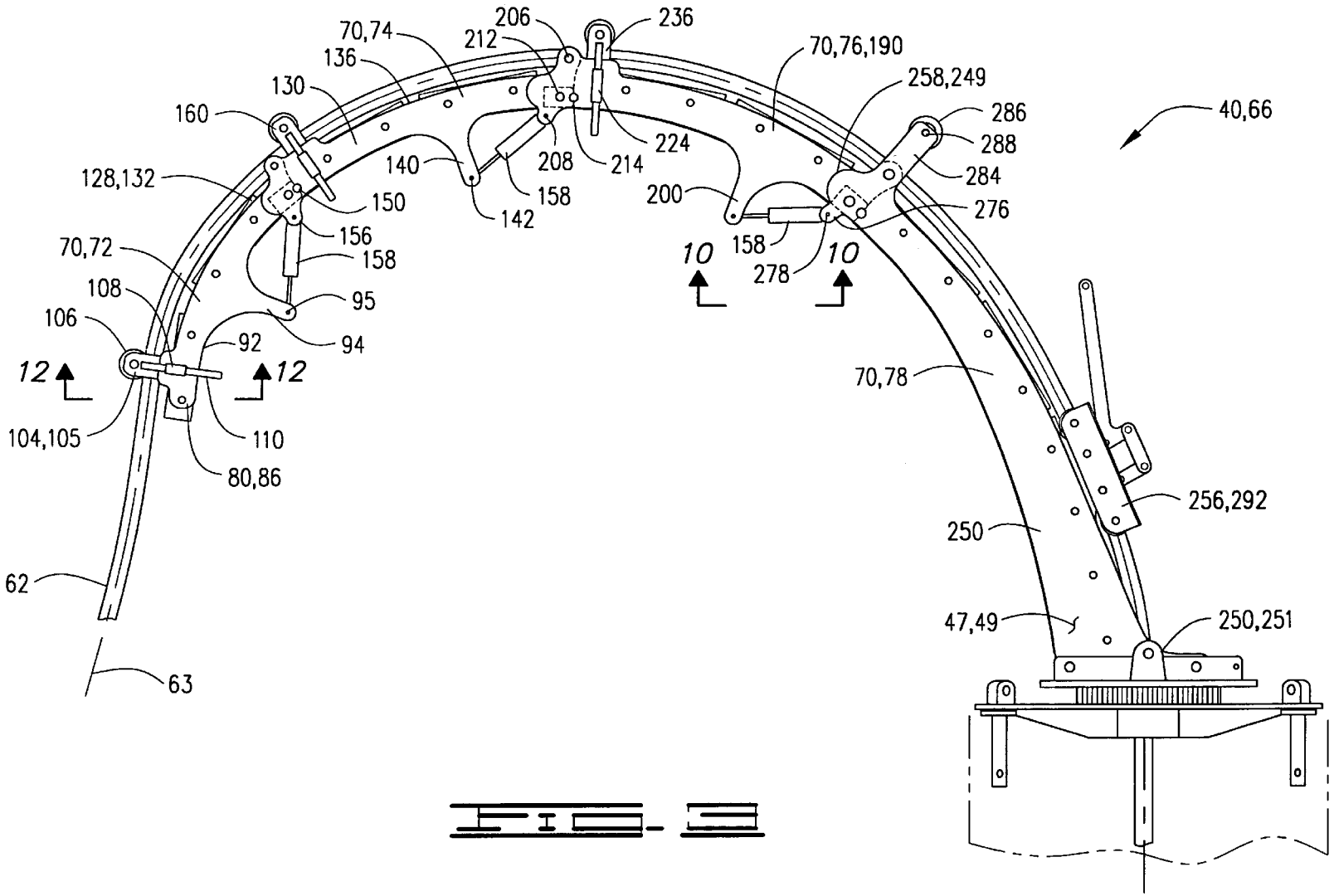
FIG. 3 is a right side elevation view of the tubing guide of the present invention.
Figure 4:
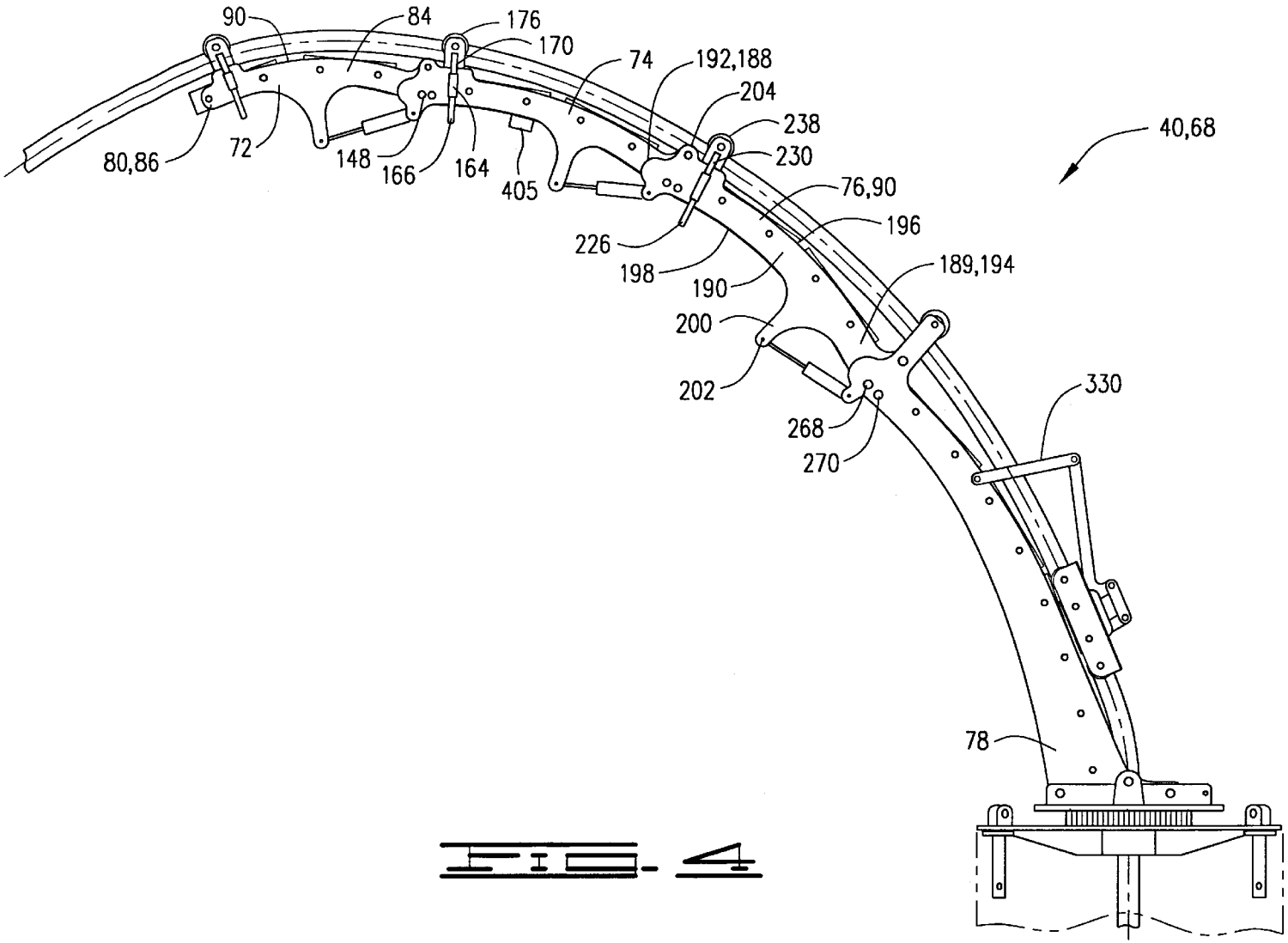
FIG. 4 is a right side elevation view of the tubing guide of the present invention in a rotated position.

Referring now to FIGS. 2–4, the tubing guide 40 of the present invention is shown. The tubing guide 40 may be referred to as a segmented tubing guide and may also be referred to as a conformable tubing guide since, as will be described in detail hereinbelow, the tubing guide is conformable to a variety of different shapes to accommodate coiled tubing having different natural or residual radii of curvature. As referred to herein, the natural, or residual radius of curvature is the radius of curvature of the coiled tubing after it is uncoiled from the reel. The radius of curvature will likely not be constant, and will be different for a tubing going into a well as opposed to when the tubing is being retracted from a well.

Tubing guide 40 includes a frame 45 which may be referred to as a tubing carrier, and may be specifically referred to as a primary tubing carrier 45. Frame 45 has left side 46, right side 47 and tubing supports 48 therebetween defining tubing support surfaces 49. As is apparent from the perspective view in FIG. 2, tubing supports 48 are, in the preferred embodiment, wear blocks which have a V-groove in the upper surface thereof to support the tubing that is being guided thereon into the tubing injector. Tubing carrier 45 may be referred to as a segmented or conformable tubing carrier and may be conformed to approximate different radii of curvature so that it can be conformed to more nearly approximate the shape of the coiled tubing that will be extended from the reel and directed into or retracted from the well. In other words, the tubing guide will conform to different shapes which allow the coiled tubing to follow a path that more nearly approximates its residual radius of curvature than if the tubing guide were rigid. Tubing guide 40 further includes a base 50 which may comprise an upper base portion 55 rotatably attached to a lower base portion 60 in any manner known in the art. The tubing guide is adapted to be connected to a tubing injector assembly 64 which is shown in phantom lines in FIG. 3, so that a tubing 62, having longitudinal central axis 63 can be directed with tubing guide 40 through lower base portion 60 thereof into tubing injector assembly 64 into a well.

Tubing guide 40 is shown in its retracted or closed position 66 in FIG. 3 and in a rotated or open position 68 in FIG. 7. In closed position 66, the tubing guide has a plurality of radii of curvature similar to that shown in U.S. Pat. No. 5,799,731, and thus in its closed position is a variable radius as opposed to a constant radius tubing guide. Tubing guide 40 is movable between its retracted position 66 and its rotated or open position 68 and may be positioned at either of those positions or anywhere in between to accommodate and more nearly approximate the natural radius of curvature of the coiled tubing being installed in or retracted from the well. In closed position 66, the radius of curvature of the tubing varies as it passes over the tubing guide. In its rotated position, tubing guide 40 conforms to a greater radius of curvature. In other words, the tubing guide conforms, or adjusts to allow a coiled tubing with a larger radius of curvature than will naturally bend around the guide in closed position 66, to follow a path that more closely approximates its residual radius of curvature.

Frame 45 has a plurality of frame segments 70. Segments 70 may comprise a forward or tip segment 72, which may also be referred to as a first segment, a first intermediate segment 74, a second intermediate segment 76 and rear or base segment 78. Segments 74, 76 and 78 may be referred to as second, third and fourth segments, respectively. The segments are rotatably or pivotably connected to one another so that first segment 72 is rotatably or pivotably connected to the adjacent segment or second segment 74. Second segment 74 not only has a pivotal connection to adjacent segment 72 but is pivotably or rotatably connected to third segment 76. Third segment 76 in addition to being pivotably connected to adjacent section 74 is pivotably connected to fourth or base section 78. Base section 78 is attached to base 50 of the tubing guide 40 in a manner known in the art.

First or tip segment 72 has a first or forward end 80 and a second or rear end 82. Segment 72 further comprises a pair of opposed side plates 84 having wear blocks 48 connected therebetween. Side plates 84 have a first or forward end 86, a second or rear end 88, an upper edge 90 and a lower edge 92. Side plates 84 have a lug or tab 94 defined thereon. Lugs 94 have openings 95 therethrough. Lugs 94 may be referred to as downwardly extending lugs. Plates 84 likewise have ears 96 defined at the rear end 88 of each plate. Ears 96 extend upwardly from edge 90 and have openings 98 defined therethrough. These features are better seen in FIGS. 7A and 7B which show the rear end of first segment 72. A limiting block 100 is attached by welding or other means to plates 84. A groove 102 which is preferably a semicircular groove 102 is defined in the ends 88 of plates 84 and in limiting block 100 which may be referred to as a first limiting block 100. Each plate 84 has a hinged ear 104 extending upwardly from edge 90. In FIGS. 2 and 3, hinged ears 104 are shown in an upright or operating position 105 and support an upper forward roller 106. Hinged ears 104 are hingedly connected to plates 84 with a spring loaded hinge 107 which can be of any type known in the art. Side plates 84 each have a handle mounting bracket 108 welded or otherwise attached thereto. Although the two plates 84 are essentially identical, the features thereon may at times be designated by the subscripts $_R$ and $_L$ (i.e., $\mathbf{84}_R$ and $\mathbf{84}_L$) simply to designate right and left and for ease of identification and description.

A handle 110 is connected to first segment 72 with mounting brackets 108. Handle 110 has a right leg 112, a left leg 114 and a handle grip 116 connected between legs 112 and 114. Handle 110 may also have a cross-brace 118 connected to legs 112 and 114. A spring is mounted in at least one and preferably both of mounting brackets 108 and is attached to the legs 112 and 114 extending therethrough. The springs urge handle 110 to the position shown in FIGS. 2–4 so that legs 112 and 114 hold hinged ears 104 in the upright position 105.

Figure 12:
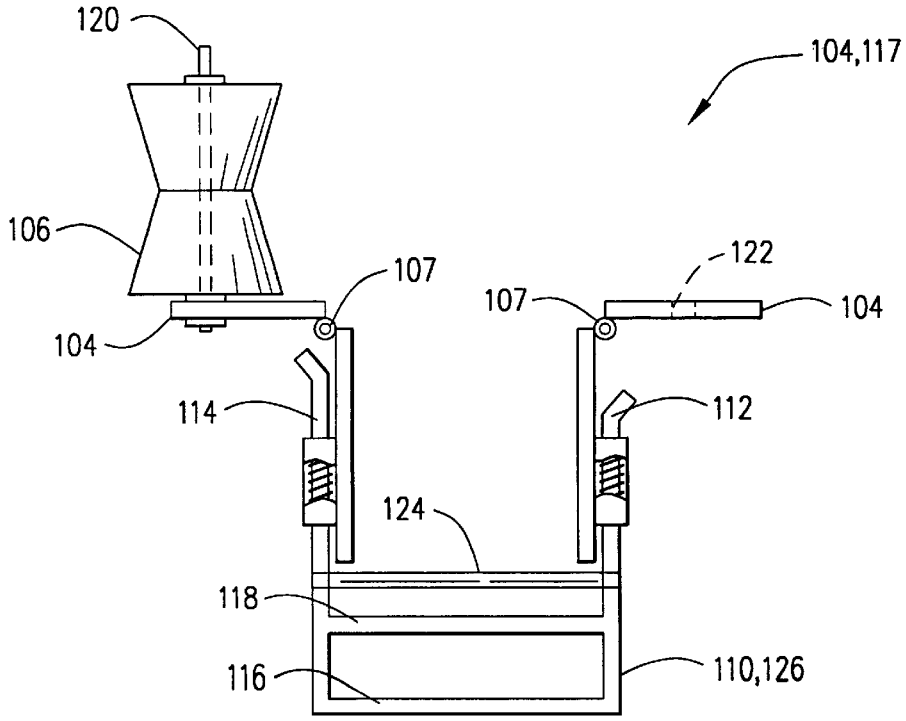
FIG. 12 is a view taken from line 12—12 of FIG. 3 and shows a roller in an installation position.

Handle grip 116 can be grasped and pulled downwardly so that as shown in FIG. 12 legs 112 and 114 no longer engage hinged ears 104. Spring loaded hinges 107 will cause ears 104 to rotate outwardly to an open, or installation position 117. Roller 106 is attached to only one of the ears 104. As seen in FIG. 12, a pin 120 extends through roller 106. Each of ears 104 has an opening 122 defined therein. When the ears are in the upright position as shown in FIGS. 2–4, pin 120 will extend through the openings in both of hinged ears 104. In the embodiment shown, roller 106 is attached to the hinged ear $\mathbf{104}_L$ or the hinged ear attached to left plate $\mathbf{84}_L$. Pin 120 and thus roller 106 may be attached by any means known in the art, such as with cotter pins on either side of ear 104. Likewise, a cotter pin or other means known in the art can be positioned on the opposite side of roller 106 to attach the roller to the pins 120.

Preferably, one of legs 112 or 114 is longer than the other. The long leg, in this case leg 114, is positioned on the same side to which roller 106 is attached. Thus, when the handle 110 is pulled downwardly, hinged ear $\mathbf{104}_R$ will be allowed to rotate downwardly as urged by spring loaded hinge $\mathbf{107}_R$ before leg 114 allows hinged ear $\mathbf{104}_L$ to move downwardly. Likewise, when handle 110 is moved upwardly, leg 114 will cause hinged ear $\mathbf{104}_L$ to rotate upwardly to its upright position so that roller 106 will essentially be in the position shown in FIG. 2 prior to the time leg 112 causes hinged ear $\mathbf{104}_R$ to fully rotate upwardly so that the end of pin 120 will extend through hole 122 in hinged ear $\mathbf{104}_R$. By arranging the assembly in this way, the opening 122 in hinged ear $\mathbf{104}_R$ can be sized such that when pin 120 extends therethrough it will support pin 120 and thus will support roller 106. If both hinged ears $\mathbf{104}_R$ and $\mathbf{104}_L$ were rotated outwardly or inwardly at the same time, opening 122 in hinged ear $\mathbf{104}_R$ would have to be significantly larger than pin 120. The present arrangement is such that the hole 122 must be larger than pin 120 so that it can receive the pin, but the size can be essentially the same size, or only slightly larger than hole 122 in hinged ear $\mathbf{104}_L$ Ample support is thus provided to roller 106 in both hinged ears 104. As shown in FIG. 12, legs 112 and 114 may have openings therethrough such that when handle 116 is pulled downwardly a pin 124 can be positioned therethrough to hold handle 116 in its lowered position 126.

Second segment 74 has forward end 128, rear end 129 and has opposed side plates 130 with wear blocks 48 connected therebetween. Opposed side plates 130 have essentially the same features, but the subscripts $_R$ and $_L$ may be used from time to time for ease of identification and description. Side plates 130 have a forward end 132, a rear end 134, an upper edge 136 and a lower edge 138. Plates 130 have downwardly extending tabs or lugs 140 positioned between the front and rear ends 132 and 134. Tabs 140 have openings 142 therein. Plates 130 have ears 144 extending upwardly from the upper edge 136 thereof near forward end 132. Each plate 130 has an opening 146 through ears 144. Plates 130 have a pair of limit holes which may be referred to as a forward limiting hole 148 and a rear or aft limiting hole 150.

Figure 7A:
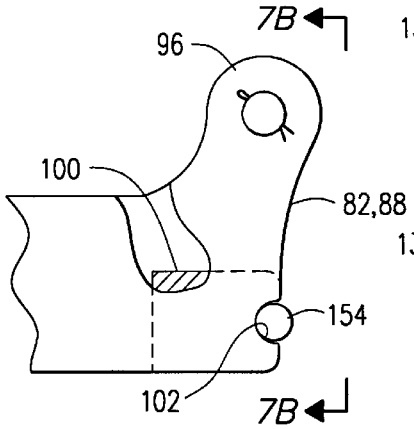
FIG. 7A is a side view of the rear end of the forward segment of the segmented tubing guide of the present invention.
Figure 7B:
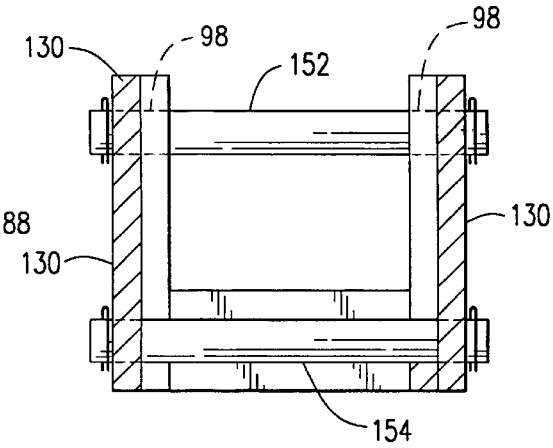
FIG. 7B is a view taken from line 7B—7B of FIG. 7A and shows in section the side plates of the segment attached to the rear end thereof.

FIG. 7A shows the rear end of segment 72 but does not show side plates 130 of segment 74. FIG. 7B is a view taken from lines 7B—7B but adds the side plates 130 which are shown in section in FIG. 7B. A pin 152 extends through openings 146 in plates 130 and through openings 98 in plates 84. Pin 152 can be attached in any manner known in the art. Thus, segments 72 and 74 are rotatably or pivotably connected with pin 152. Inward rotation or counterclockwise rotation as seen in FIG. 3 is limited by a limiting pin 154 which can be inserted through holes 148 or 150. In the embodiment shown, pin 154 is positioned through holes 150 so that segment 72 is in its fully closed position, and holes 148 are open. If desired, pin 154 can be positioned in holes 148 so that segment 72 is slightly extended or rotated upwardly and is prevented from inward rotation by pin 154. Referring again to FIGS. 7A and 7B, pin 154 is shown in FIG. 7A without side plates on segment 74. FIG. 7B shows pin 154 extending through side plates 130 of segment 74. Thus, as is apparent from the drawings, the inward rotation is limited since limiting block 100, along with side plates 84 of segment 74, will engage pin 154 thus preventing any further inward rotation.

Each plate 130 has a downwardly extending shock attachment lug 156 near the forward end 132 thereof. An actuating mechanism 158, which in the embodiment shown is a coil overshock 158, is attached to a pin extending through lugs 156 and a pin extending through lugs 94. The coil overshock can be of any type known in the art. The upward or clockwise rotation of segment 72 as seen in FIG. 4 is thus limited by the amount of extension allowed by coil overshock 158. While coil overshocks are described here, hydraulic pistons or other means can be used to aid in rotation and in limiting rotation.

Hinged ears 160 are hingedly connected to plates 130 with a spring loaded hinge like that described with respect to hinged ears 104. Handle mounting brackets 164 are attached to side plates 130 below hinged ears 160 by welding or other means known in the art. A handle 166 is attached with handle mounting brackets 164. Handle 166 has legs 168 and 170. Handle 166 also has a handle gripping brace 172 and a cross-brace 174 extending between and connecting legs 168 and 170. As described with respect to handle mounting brackets 108, spring (not shown) will be housed in at least one, and preferably both mounting brackets 164 and connected to legs 168 and 170. The springs will urge handle 166 to the position shown in FIGS. 2 and 3 so that legs 168 and 170 hold hinged ears 160 in the upright position as shown in FIGS. 2–4. The upright, or operating position is referred to as position 105. Roller 176 is thus supported by hinged ears 160 when the hinged ears are in the upright position. Roller 176 may be referred to as a second upper roller 176. Handle 176 may thus be pulled downwardly and placed in a lowered position as described with reference to the handle 110. Hinged ears 160 will be rotated outwardly by spring loaded hinges to open ears 160 to installation position 117. In the embodiment shown, leg 168 is longer than leg 170 such that ear 160 on right side plate $\mathbf{130}_R$ will open first but will close last when handle 166 is pulled downwardly and then released so that it can move upwardly and urge hinged ears 160 to the upright position where roller 176 is supported by both ears 160.

Figure 8A:
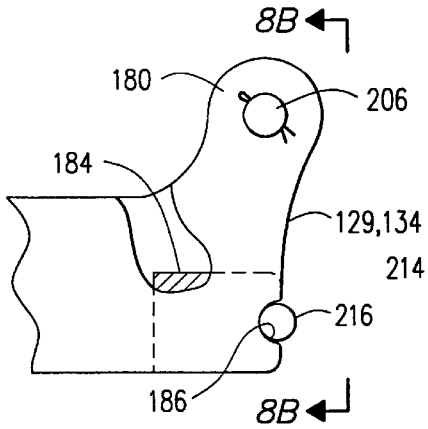
FIG. 8A is a side view of a rear end of one of the intermediate segments of the tubing guide of the present invention.

Plates 130 each have an upwardly extending ear 180 having an opening 182 therein near the rear end 134 thereof. FIG. 8A shows a view of the rear end of segment 74. A limiting block 184 is welded or otherwise connected to plates 130. A groove or notch which is preferably a semicircular groove 186 is defined in block 184 and extends through side plates 130 at the rear end thereof.

Segment 76 has forward end 188, rear end 189, and comprises side plates 190 having wear blocks 48 connected thereto by any means known in the art. Side plates 190 have a forward end 192, a rear end 194, an upper edge 196 and a lower edge 198. Side plates 190 have downwardly extending lugs or tabs 200 between ends 192 and 194 and have openings 202 therein. Plates 190 have essentially the same features but the subscripts $_R$ and $_L$ may be used simply for ease of identification and description. Plates 190 have lugs or ears 204 extending upwardly on upper edge 196 near the forward end 192 thereof. Lugs 204 have openings 206 therethrough. Plates 190 likewise may have shock attachment lugs 208 with openings 210 therethrough near forward end 192 thereof at lower edge 198. Plates 190 also have forward and rear limiting holes 212 and 214 therethrough.

Figure 8B:
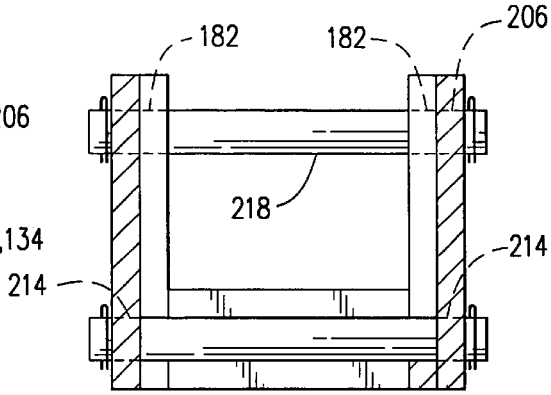
FIG. 8B is a view from line 8B—8B of FIG. 8A and shows in section the side plates of the segment attached to the rear end thereof.

Referring now to FIGS. 8A and 8B, rear end 129 of segment 74 is shown without side plates 190 on segment 76. FIG. 8B shows side plates 190 in section. In the embodiment shown, a limiting pin 216 is installed in rear limit holes 212 and holes 214 are left open. As is apparent, downward or counterclockwise rotation as seen in FIG. 3 is prevented when limiting block 184 engages pin 216. Pin 216 can be positioned in either of holes 214 or 212 depending on the position in which is desired to hold the second segment 74. A pin 218 extends through lugs 180 in plates 130 and through ears 204 in plates 190 so that segment 74 rotates or pivots about pin 218, relative to segment 76. An actuating mechanism, such as coil overshock 158, is connected to lugs 140 with a pin 220 and is attached to lugs 208 with a pin 222 extending therethrough. As is apparent, the pins 220 and 222 extend all the way through the lugs and may be attached in any manner known in the art. Likewise, coil overshock 158 may be attached to the pins by any manner known in the art. Thus, upward or clockwise rotation as seen in FIG. 4 is limited by the amount of extension of coil overshock 158.

Handle mounting brackets 224 are welded or otherwise connected to side plates 190. Handle 226 is attached to segment 76 with mounting brackets 224. Handle 226 includes leg 228 and leg 230. Legs 228 and 230 are connected together with a cross-brace 232 and a handle grip 234. Handle 226 is similar to handles 110 and 166 in that one leg, and in the embodiment shown leg 228, is longer than the other leg 230. In the position shown in FIGS. 2–4, legs 228 and 230 hold hinged ears 236 which extend upwardly on upper edge 196 in upright position 105 so that they will support a roller 238. Handle 226, like handles 110 and 166, can be pulled downwardly and a pin inserted in holes (not shown) through the handles to hold handle 226 in a lowered position. When handle 226 is in the lowered position, hinged ears will be rotated outwardly by spring loaded hinges which hingedly connect ears 236 to plates 190. When handle 226 is in its lowered position, hinged ears will thus be rotated outwardly as described and shown with respect to hinged ears 104 on segment 72, and will be in an open or installation position 117. Roller 238 will be attached to the hinged ear on plate $\mathbf{190}_L$ since left leg 228 is the longer handle leg. As is described with handles 110 and 166, a spring is mounted in at least one of brackets 224 and thus to at least one of legs 228 and 230 so that the handle 226 is normally urged upwardly to the position shown in FIGS. 2–4 to hold hinged ears 236 in upright position 105 to support roller 238.

Figure 9A:
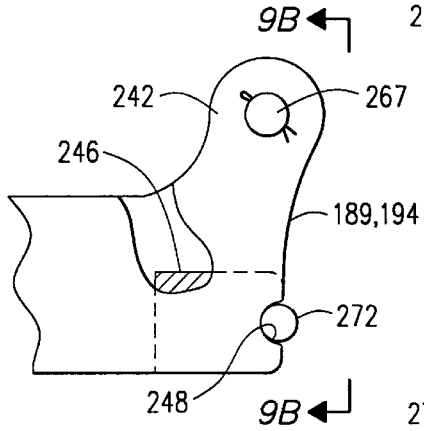
FIG. 9A is a view of the rear end of another of the intermediate segments of the present invention.

Referring now to FIG. 9A, plates 190 have lugs 242 extending upwardly on the upper edge thereof at rear end 194. Holes 244 extend through lugs 242. A limiting block 246 is welded to both of plates 190. The limiting block has a groove 248 defined therein which is preferably a semicircular groove 248. Groove 248 extends through both of plates 190. Although in the drawings the rear ends of segments 72, 74 and 76 are depicted as the same size, the segments preferably increase in size from the forward end to the rear end, so that the rear end of segment 74 will be larger than the rear end of segment 72, and the rear end of segment 76 will be larger than the rear end of segment 74.

Figure 9B:
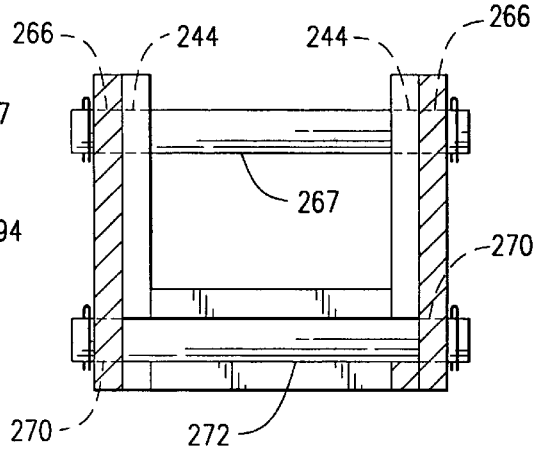
FIG. 9B is a view taken from line 9B—9B of FIG. 9A and shows in section the side plates of the segment attached thereto.
Figure 10:
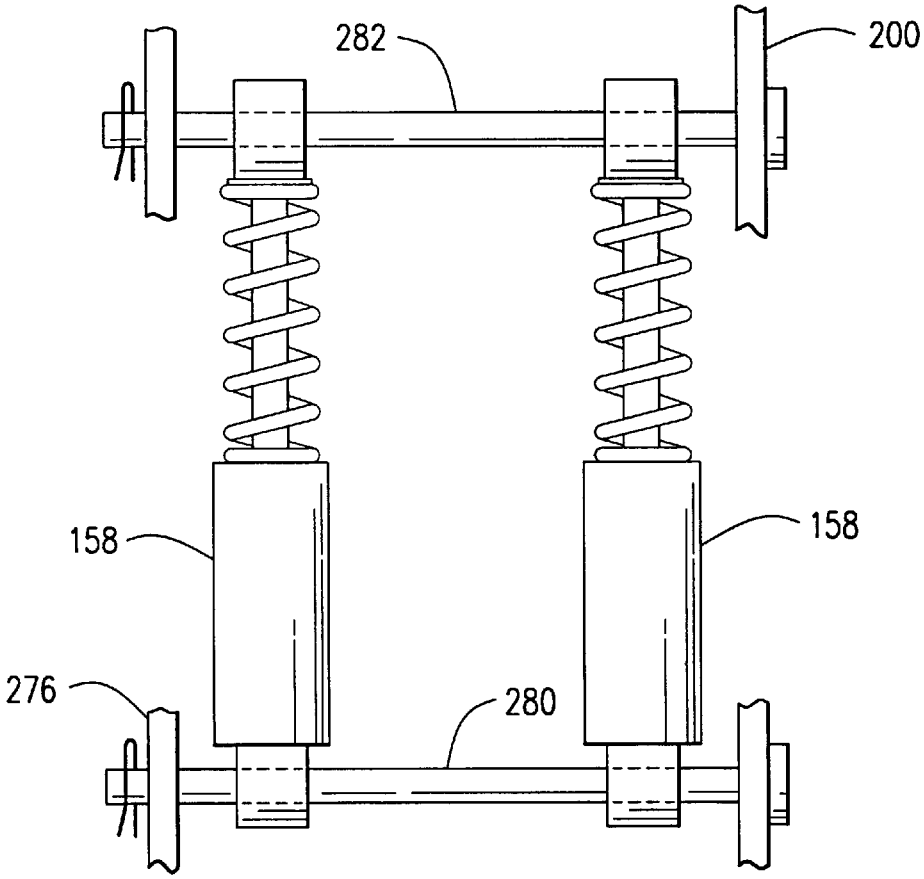
FIG. 10 is a view from lines 10—10 of FIG. 3.
Figure 11:
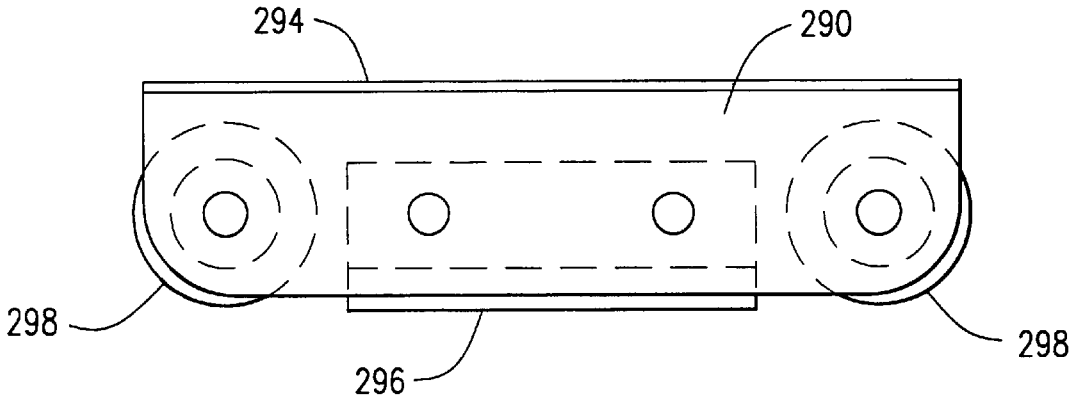
FIG. 11 shows the detail of the shield of the present invention.

Segment 78 has forward end 249, rear end 251 and includes a right side plate 250 and a left side plate 252. Right and left side plates 250 and 252 are essentially identical except that left side plate 252 has a shield mounting lug 254 for mounting a shield 256 thereto. Because the plates are virtually identical, the same reference numbers will be used to identify features that are on both side plates. Side plates 250 and 252 have a forward end 258 and a rear or base end 260. A plurality of wear blocks 48 are connected to plates 250 and 252 by any means known in the art. Plates 250 and 252 have openings 266 for receiving a pin 267 to connect segment 76 to segment 78. Plates 250 and 252 have forward and rear limiting pin holes 268 and 270, respectively. In FIGS. 2–4, a limit pin 272 is received through holes 270 and holes 268 are left open. Thus the segment 76 is prevented from rotating inward or counterclockwise in FIG. 3 by limit pin 272. Referring now to FIGS. 9A and 9B, rear end 189 of segment 76 is shown without right and left side plates 250 and 252 of segment 78, which are shown in section in FIG. 10. Limit pin 272 is shown in FIGS. 9 and 10. Pin 267 is received through openings 244 in segment 76 and openings 266 in segment 78 so that segment 76 rotates about pin 267 and thus will rotate relative to segment 78. As set forth previously, counterclockwise rotation as seen in FIG. 3 is prevented by the engagement of limit block 246 with limit pin 272. Plates 250 and 252 have shock mounting lugs 276 having openings 278 therein near the forward end of plates 252 and 254. A pin 280 extends through lugs 276 and may be attached thereto by any means known in the art.

A pin 282 extends through openings 202 and lugs 200. As seen in FIG. 10, two actuating mechanisms, which may be coil overshocks 158 are connected to pins 280 and 282. Thus, the upward or clockwise rotation of segment 76 as shown in FIG. 4 is limited by the extension of coil overshocks 158. Side plates 250 and 252 have a roller mount 284 extending upwardly therefrom so that a roller 286 can be mounted thereto. Roller 286 is attached with a pin 288 or other means known in the art. As is apparent, roller 286 is positioned a greater distance away from the surface of wear blocks 48 than are rollers 106, 176 and 238.

Figure 5:
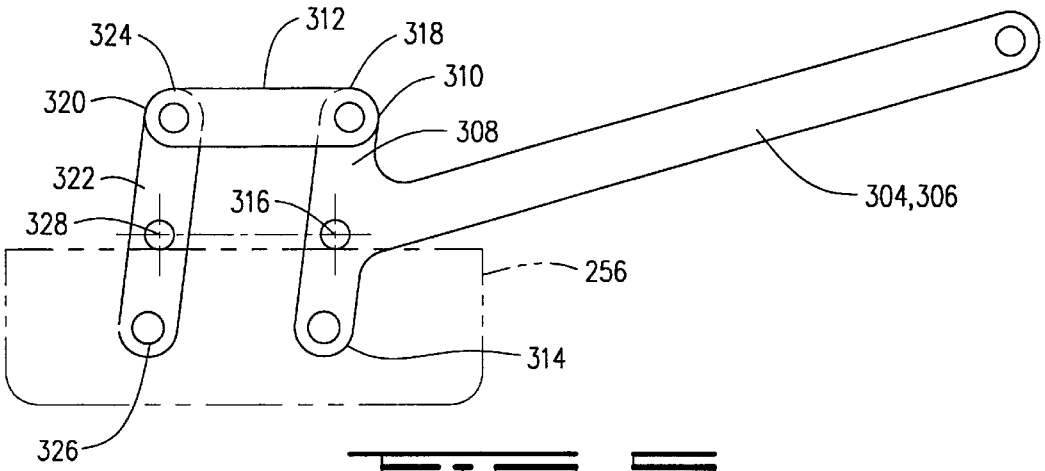
FIGS. 5 and 6 show a linkage used to move the shield used with the present invention.
Figure 6:
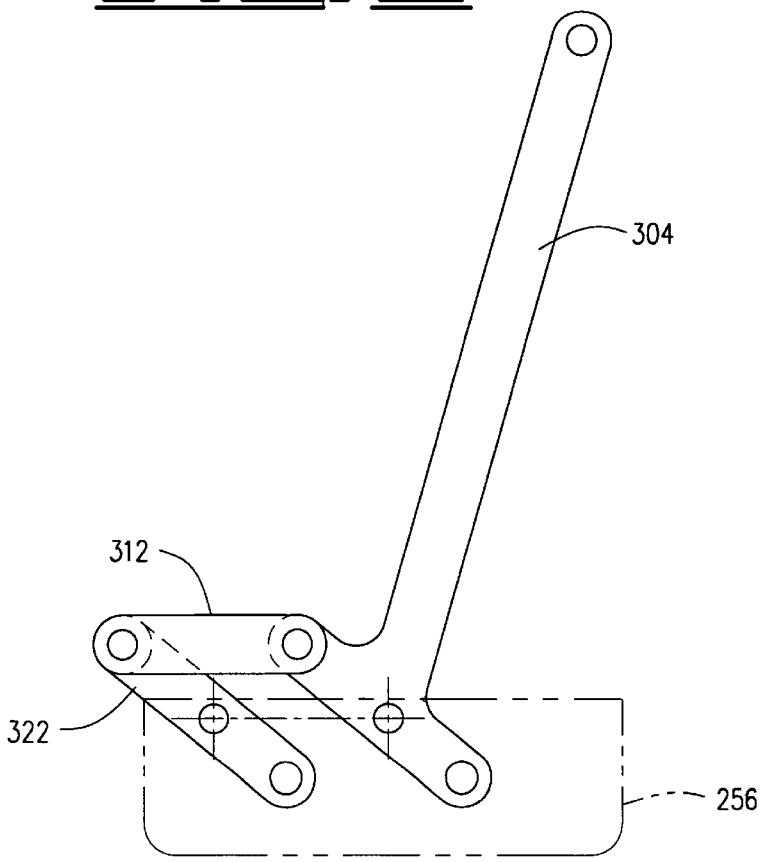
Figure 13:
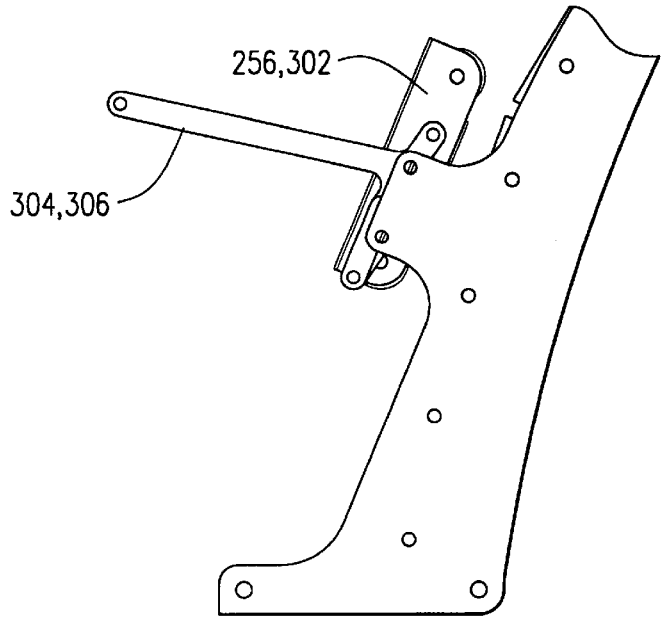
FIG. 13 shows the shield of the present invention in an open position.

Shield 256 comprises a right side plate 290, a left side plate 292 and a cap 294. A wear block 48 along with rollers 296 and 298 are mounted to side plates 290 and 292. In FIGS. 2 and 3, the shield is shown in a closed position 300. In FIG. 13, the shield is shown rotated to an open position 302. Shield 256 is moved from the closed to the open position simply by pulling upwardly or clockwise in FIG. 3 on handle 304. Handle 304 is essentially a T-shaped handle having a long leg 306 and a T-bar 308. The T-bar is connected at an upper end 310 to an upper link 312 and is connected at its lower end 314 to side plate 292. The details of the handle 304 and linkage are better seen in FIGS. 5 and 6. The T-bar is connected generally at the midpoint 316 between ends 310 and 314 to shield mounting lug 254. Upper link 312 is attached at its first end 318 to T-bar 308 and is attached at its second end 320 to a link 322 which is generally parallel to T-bar 308. Link 322 is connected at its upper end 324 to upper link 312 and at its lower end 326 to side plate 292 of shield 256. Link 322 is attached at its midpoint 328 to shield mounting lug 254. The attachment can be with bolts or any means known in the art. If desired, shield 256 can be locked in its closed position by simply attaching a metal strap 330 to leg 306 and to side plate 250. To move the shield to open position 302, it is simply required to move the handle in the clockwise position as shown in FIG. 3 which will place the shield in open position 302. Shield 256 may have rollers 330 and a wear block 332 connected between plates 290 and 292.

The operation of tubing guide 40 of the present invention is apparent from the drawings and is as follows. Tubing guide 40 is positioned in a desired location near a coiled tubing reel. The coiled tubing 62 is then unspooled.

Each of handles 110, 166 and 226 are pulled into their lowered position so that hinged ears 104, 160 and 236 rotate outwardly to installation position 117. The shield is moved to its open position 302 and the end of the coiled tubing is urged between rear upper roller 286 and wear blocks 48. The coiled tubing is then stabbed between shield 256 and is urged downwardly through base 50. As is known in the art, it may be necessary to clamp tubing 62 to tubing guides, preferably to the base, so that it will not slip therefrom, especially if the tubing is stabbed therethrough and the tubing guide is thereafter moved to the coiled tubing injector with the tubing installed. Once the tubing has been urged through base 50, the shield is moved to its closed position 300 and may be latched in place.

If tubing 62 is then resting on or near wear blocks 48, the tubing may simply placed around the tubing guide and the handles 110, 166 and 226 released so that upper rollers 106, 176 and 238 are positioned over tubing 62. If, however, the tubing is spaced from wear blocks 48, the tubing must be brought into engagement with the tubing guide. With prior tubing guides, a come-along as described hereinabove, or other mechanical means would typically be required to pull the coiled tubing down to the tubing guide. With the present invention, however, force applied upwardly, or clockwise in FIG. 3, will cause rotation of each of segments 72, 74 and 76 upwardly to meet, or engage tubing 62. The spring force of the coil overshocks 158 can be adjusted as desired. Preferably, the spring force in each of coil overshocks 158 is such that an upward force, such as hand pressure applied by an operator will cause clockwise pivoting movement as seen in FIG. 3. Tubing guide 40 is shown in its fully expanded or rotated position in FIG. 4. Because tubing guide 40 will adjust, it will conform to or will more nearly approximate the residual radius of the coiled tubing being placed thereon so that the coiled tubing 62 can follow a path more closely approximating its residual radius.

Thus, the coil overshocks 158 will aid rotation and the rotation can be continued until the shape of the tubing guide very nearly approximates the natural radius of curvature of the coiled tubing. At that point the handles can be released so that the tubing will be positioned beneath each of the rollers and can be supported by the wear blocks. It is believed that the largest natural radius of curvature utilized with coiled tubing, which varies with wall thickness and typically ranges from approximately one inch to three and one-half inches in diameter, is an approximate two hundred and forty inch radius. Thus, in its rotated condition as shown in FIG. 4, the tubing guide should conform to a shape such that a coil tubing with an approximate two-hundred-forty-inch residual radius can be positioned thereon with less bending stresses than are experienced with prior art tubing guides. The invention is not, however, limited to a specific radius of curvature. Obviously, any number of radii can be approximated since each of segments 72, 74 and 76 may rotate independently of one another. As such, tubing guide 40 of the present invention is conformable, or is adapted to conform to any number of shapes to approximate the curvature of the coiled tubing being installed thereon. Once the tubing is installed in the manner herein, the tubing guide, if not already positioned over the tubing injector can then be connected to tubing injector 64 and the coiled tubing may be unclamped from the base if it has been clamped thereto. The present invention thus eliminates, or at least lessens, rig-up problems and ultimately saves money since the bending stresses in the coiled tubing are lessened and will extend the life of the coiled tubing. As the coiled tubing is spooled off of the reel and moved into the injector and the well, the segments may be move so that variations in the curvature of the tubing 62 can be accommodated and bending stresses can even further be reduced. In other words, the tubing guide is not fixed in its position once the tubing is in place. Rather, the coil overshocks are adjusted to allow pivoting of the segments so that if the tubing shape itself tries to pull a segment upwardly, or if the weight of tubing pushes downwardly, the segments may pivot. Thus the shape of the tubing guide may conform, or adjust, as tubing is being directed thereby into a well, and as tubing is being retracted therefrom. Although coil overshocks are described here, other types of mechanisms, such as hydraulic pistons may be used. Thus, the tubing may cause the segments to continue to rotate and to approximate the radius as the tubing passes therethrough. The amount of movement can be measured by utilizing commercially available equipment to monitor the change in angles between the segments and to send a real time signal so that the change in bend radius can be calculated. Such information can be utilized to predict tubing fatigue.

Thus, the present invention is well adapted to carry out the objects and attain the ends and advantages mentioned herein as well as those which are inherent. While numerous changes may be made by those skilled in the art, such changes are encompassed within the scope and spirit of the invention as defined by the appended claims.

What is claimed is:

1. A tubing guide for use with a tubing injector for injecting and withdrawing tubing from a well, the tubing guide comprising:

a base; and a frame extending from said base for directing said tubing, said frame comprising a plurality of frame segments, at least a portion of said segments being pivotable relative to an adjacent segment so that a shape of said frame is adjustable.

2. The tubing guide of claim 1, said tubing guide having a closed position and being movable between said closed position and a rotated position.

3. The tubing guide of claim 2, wherein said tubing guide is a variable radius tubing guide in said closed position.

4. The tubing guide apparatus of claim 1, wherein said segments comprise a pair of opposed side plates having wear blocks connected therebetween.

5. The tubing guide of claim 1, wherein each segment has a forward end and a rear end, said pivotable segments being pivotably connected at or near the rear ends thereof to a location at or near the forward end of an adjacent segment.

6. The tubing guide of claim 1, said plurality of segments comprising:

a tip segment;

at least one intermediate segment connected to said tip segment; and a base segment connected to said at least one intermediate segment, said base segment being connected to said base of said tubing guide.

7. The tubing guide of claim 1, said frame comprising:

opposed side plates;

tubing supports having a tubing engagement surface thereon connected between said side plates; and a plurality of upper rollers, said upper rollers being movable between an operating position wherein said rollers are positioned over said tubing supports so that said tubing will pass between said rollers and said tubing supports and an installation position, wherein in said installation position said rollers are located such that said tubing can be brought into engagement with said tubing without interference from said rollers.

8. The tubing guide of claim 7, wherein said upper rollers are supported by opposed ears hingedly connected to said side plates.

9. The tubing guide of claim 8, wherein each of said rollers is attached to one of said hinged ears, so that said roller will rotate as said hinged ear rotates about said hinged connection.

10. The tubing guide of claim 1 further comprising limiting means for limiting the pivoting movement of said segments.

11. The tubing guide of claim 1:

wherein shape of said frame conforms as tubing is guided thereby, so that said frame provides a travel path for said tubing that will conform to try to approximate a radius of curvature of said tubing.

12. The tubing guide of claim 1 further comprising:

means for monitoring the change in angles between said segments of said frame as said tubing passes therethrough.

13. A tubing guide for guiding coiled tubing into a tubing injector, the tubing guide comprising:

a base adapted to be positioned over said tubing injector; and a tubing carrier for directing said tubing through said base and into said injector, wherein said tubing carrier has an adjustable shape.

14. The tubing guide of claim 13 wherein said tubing carrier will change shape as the radius of curvature of tubing passing therethrough changes to provide a path for said tubing that will move to more closely approximate the radius of curvature of said tubing.

15. The tubing guide of claim 13, wherein said carrier has a fully closed position and a fully rotated, or open position, and wherein said carrier may be in said fully open, said fully closed, or may adjust to a shape between its frilly open and fully closed positions.

16. The apparatus of claim 15, wherein said carrier will conform as tubing is guided thereby so that the carrier will change shape to accommodate changes in radius of curvature of said tubing to lessen bending stresses on said tubing.

17. The tubing guide of claim 13, said carrier comprising a plurality of tubing carrier segments.

18. The tubing guide of claim 17, wherein said tubing carrier segments are connected to allow pivotable movement relative to adjacent segments.

19. The tubing guide of claim 18, said segments being connected to adjacent segments with an actuating means to aid in the pivotable movement of said segments.

20. The tubing guide of claim 19, wherein said actuating means comprises a coil overshock.

21. The tubing guide of claim 17, said segments comprising:

a forward segment, at least one intermediate segment, and a base segment connected to said tubing guide base.

22. The tubing guide of claim 21, wherein said at least one intermediate segment comprises first and second intermediate segments, said forward segment being pivotably connected to said first intermediate segment, said first intermediate segment being pivotably connected to said second intermediate segment, and wherein said at least second intermediate segment is pivotably connected to said base segment.

23. The tubing guide of claim 17 wherein said segments comprise:

opposed side plates; and tubing supports positioned between and connected to said side plates.

24. Apparatus for guiding coiled tubing for use in connection with a coiled tubing injector, the apparatus comprising:

a tubing guide comprising a primary tubing carrier with an adjustable shape for conforming to accommodate coiled tubings having different radii of curvature.

25. The apparatus of claim 24, wherein the primary tubing carrier is comprised of a plurality of movable segments.

26. The apparatus of claim 25, wherein said movable segments are pivotable segments.

27. The apparatus of claim 26, wherein said segments are pivotable relative to an adjacent segment.

28. The apparatus of claim 24, wherein said primary tubing carrier comprises:

a forward segment;

at least one intermediate segment connected to said forward segment; and a base segment connected to said intermediate segment and connected to a base of said tubing guide.

29. The apparatus of claim 28, wherein said forward, intermediate and base segments are pivotable relative to adjacent segments.

30. The apparatus of claim 24, wherein said primary tubing carrier adjusts to provide an adjustable travel path for coiled tubing directed thereby.

* * * * *